United States Patent [19]

Parikh et al.

[11] 3,956,027

[45] May 11, 1976

[54] PROCESSING COPPER BASE ALLOYS

[75] Inventors: Prakash D. Parikh; Eugene Shapiro, both of Hamden, Conn.

[73] Assignee: Olin Corporation, New Haven, Conn.

[22] Filed: Apr. 9, 1975

[21] Appl. No.: 566,273

[52] U.S. Cl. ..... 148/11.5 R

[51] Int. Cl.[2] ..... C22F 1/08

[58] Field of Search ..... 148/11.5 C; 75/153, 75/154, 157.5, 162, 160

[56] References Cited

UNITED STATES PATENTS

| | | | |
|---|---|---|---|
| 3,816,187 | 6/1974 | Smith et al. | 148/11.5 C |
| 3,841,921 | 10/1974 | Shapiro et al. | 148/11.5 C |
| 3,852,121 | 12/1974 | Crane et al. | 148/11.5 C |
| 3,882,712 | 5/1975 | Shapiro et al. | 148/11.5 C |

*Primary Examiner*—W. Stallard

*Attorney, Agent, or Firm*—Robert H. Bachman; David A. Jackson

[57] ABSTRACT

A process for obtaining improved bend properties in copper base alloys with retention of other desirable characteristics thereof. The process is characterized by a final cold reduction with a large number of passes coupled with a small reduction per pass.

11 Claims, No Drawings

PROCESSING COPPER BASE ALLOYS

BACKGROUND OF THE INVENTION

It is highly desirable to provide copper base alloys having good bend formability coupled with good strength properties, while retaining the other advantageous properties of these alloys.

The usefulness of sheet materials is often limited by their ability to be formed by bending into a variety of desired shapes. This is particularly true when cold rolling is employed in order to strengthen the strip material since the cold working operation reduces bend ductility. In addition, cold rolling also leads to anisotropy in bend behavior where a lower bend ductility is observed when measured with the bend axis parallel to the rolling direction, that is, when the bend ductility is measured with the bend axis 0° to the rolling direction. Therefore, the most desirable combination of properties is extremely difficult to achieve, that is, high bend ductility without anisotropy combined with high strength properties and retention of other desirable properties in copper base alloys.

Heretofore, one method used in the art in order to achieve this desirable combination of properties is to control alloying ingredients. This method has met with relatively limited success and/or tends to be accompanied by one or more significant disadvantages. Control of alloying ingredients may or may not be successful, and often adds an inordinate amount of cost to the final product.

Accordingly, it is a principal object of the present invention to provide a process for obtaining a combination of good strength and good bend properties in copper base alloys.

It is a further object of the present invention to provide a process as aforesaid which is relatively convenient to use on a commercial scale and which allows the retention of other desirable properties in these alloys.

It is a particular object of the present invention to provide a process as aforesaid which enables one to obtain high bend ductility with limited anisotropy combined with good strength properties.

Further objects and advantages of the present invention will appear from the ensuing specification.

SUMMARY OF THE INVENTION

In accordance with the present invention it has now been found that the foregoing objects and advantages may be readily obtained.

The process of the present invention obtains an improved combination of strength and bend properties in copper base alloys by providing a final cold reduction step in a large number of passes with a small reduction per pass. In accordance with the process of the present invention a copper or copper base alloy strip is subjected to a final cold reduction of at least 15% using at least five passes wherein the reduction per pass varies from 0.5 to 4%. The higher the number of passes and the greater the total reduction in the cold reduction step, the greater the improvement in the properties; however, this additional improvement should be weighed against the additional inconvenience of the larger number of passes in a commercial operation. Thus, the optimum process for optimum properties utilizes at least 10 passes with a total reduction of at least 30%.

The cold reduction step must be the final step in the processing cycle. Prior processing history is not significant. Naturally, one may utilize in addition at least one larger per pass cold reduction in the final cold reduction step coupled with a plurality of smaller reductions as provided for herein. In the preferred embodiment, however, the final cold reduction is restricted to a plurality of small reduction passes as provided for herein.

DETAILED DESCRIPTION

The process of the present invention, as indicated hereinabove, may be readily utilized with any copper or copper base alloy material. Thus, commercial purity copper or pure copper may be readily utilized, such as, for example, CDA copper Alloy No. 110 which is electrolytic tough pitch copper. In addition, the iron containing copper alloys containing from 1 to 5% iron may be readily utilized, such as CDA copper Alloy 192, 194 and 195. The nickel containing copper alloys may also readily be employed, such as CDA copper Alloy 706 and 725. A particularly suitable series of alloys which show considerable improvement when processed in accordance with the present invention are those copper base alloys having a low stacking fault energy, that is, having a stacking fault energy of less than 30 ergs per square centimeter. Typically these copper alloys contain a first element selected from the group consisting of about 2 to 12% aluminum, about 2 to 6% germanium, about 2 to 10% gallium, about 3 to 12% indium, about 1 to 5% silicon, about 4 to 12% tin, about 8 to 37% zinc and the balance essentially copper. These low stacking fault energy alloys may naturally include further alloying additions. For example, the alloys may include at least one second element different from the first element selected from the group consisting of about 0.001 to 10% aluminum, about 0.001 to 4% germanium, about 0.001 to 8% gallium, about 0.001 to 10% indium, about 0.001 to 4% silicon, about 0.001 to 10% tin, about 0.001 to 37% zinc, about 0.001 to 25% nickel, about 0.001 to 0.4% phosphorus, about 0.001 to 5% iron, about 0.001 to 5% cobalt, about 0.001 to 5% zirconium, about 0.001 to 10% manganese and mixtures thereof. Typical of alloys of this type are CDA copper Alloy 638, 688, 260, 510, 511, 521, 524, 664, 745 and 752.

The starting material for the process of the present invention should be a copper or copper base alloy material in sheet form having a thickness of less than 0.500 inch gage, and preferably less than 0.200 inch gage. The starting material may be obtained in any suitable manner, with the prior processing history not being critical. Thus, one may obtain the starting sheet material from a copper base alloy ingot which is hot or cold rolled to plate thickness with or without intermediate annealing. The reduction, annealing temperature, and number of cycles is not significant and will depend upon the particular material utilized and final gage requirements.

In accordance with the process of the present invention, a final cold reduction must be employed utilizing a total cold reduction of at least 15% with at least five passes having a reduction per pass varying from 0.5 to 4%. As indicated hereinabove, the larger the total reduction and the greater the number of small reduction passes, the greater the absolute improvement in properties. Thus, optimum properties are obtained utilizing a total reduction of at least 30% and utilizing at least 10 passes having a per pass reduction varying from 0.5 to 4%. This absolute improvement in properties, however, should be counterbalanced against the commercial inconvenience of employing the greater number of reduction cycles. Naturally, one may in addition utilize at least one larger per pass reduction during the final cold reduction step provided that said final cold reduction step does employ a plurality of small reduction passes as required herein. For example, one may include in the final cold reduction cycle at least one reduction of greater than 4% and preferably at least one reduction greater than 10%. An exemplificative final cold reduction cycle may include a reduction pass of 10% coupled with 10 reduction passes varying from 0.5 to 4%.

Optionally, one may include a low temperature anneal after the final cold reduction in order to, for example, improve properties as stress corrosion resistance, stress relaxation, creep behavior, etc. Naturally the exact conditions will vary depending on the alloy; however, one may employ temperatures from 200° to 400°C for at least 15 minutes and generally not in excess of 24 hours.

The process of the present invention and improvements resulting therefrom will be more readily apparent from a consideration of the following illustrative examples.

EXAMPLES

Two copper base alloys were prepared having compositions listed in Table A below.

TABLE A

| | Composition |
|---|---|
| Alloy I | |
| CDA 638 | Silicon about 2%<br>Aluminum about 3.0%<br>Cobalt about 0.4%<br>Copper — essentially balance |
| Alloy II | |
| CDA 110 | Oxygen about 0.04%<br>Copper — essentially balance (minimum 99.90%) |

Both of these alloys were commercially processed to the hot rolled condition. Following hot rolling, Alloy I was commercially processed by cold rolling and interannealing as required at about 570°C for about one hour to the 0.080 inch gage. Alloy I was then processed to 0.050 inch gage by cold rolling about 40% to 0.050 inch gage followed by annealing at 550°C for 1 hour. Following hot rolling Alloy II was cold rolled and annealed at 600°C for 1 hour to 0.350 inch gage followed by processing to 0.075 inch gage by cold rolling about 80% to 0.075 inch gage and annealing at 350°C for 1 hour.

Both alloys were then processed to 0.030 inch gage by a final cold reduction step utilizing about 40% total cold reduction for Alloy I and about 60% total cold reduction for Alloy II. A variety of samples of each material was processed using four different cold rolling schedules for each alloy as shown in Table B below. Constant angulation and friction conditions were maintained using a roll finish of 15 micro inches, an entry angle of ¾° and continuous lubrication with a water soluble oil. Tensile strength and minimum bend radius determinations were made for both alloys after each reduction schedule and after the total 40% and 60% cold rolling reduction. The bend test compares the bend characteristics of samples bent over increasingly sharp radii until fracture is noted. The smallest radius at which no fracture is observed is called the minimum bend radius MBR. When the bend axis is perpendicular to the rolling direction it is called "good way bend", and parallel to the rolling direction is called "bad way bend". The results are shown in Table C below.

TABLE B

| PASS SCHEDULES | | |
|---|---|---|
| Alloy | Identification | Pass Schedules |
| 1 | 1-A | 20 passes of 0.001 inch |
| 1 | 1-B | 2 passes of 0.01 inch |
| 1 | 1-C | 10 passes of 0.001 inch and 1 pass of 0.01 inch |
| 1 | 1-D | 1 pass of 0.01 inch and 3 passes of 0.003 inch |
| 2 | 2-A | 22 passes of 0.002 inch |
| 2 | 2-B | 2 passes of 0.022 inch |
| 2 | 2-C | 1 pass of 0.022 inch and 11 passes of 0.002 inch |
| 2 | 2-D | 11 passes of 0.002 inch and 1 pass of 0.022 inch |

TABLE C

| TENSILE AND BEND PROPERTIES | | | | |
|---|---|---|---|---|
| Alloy | Identification | Long. UTS, psi | MBR in 64th | |
| | | | Good Way | Bad Way |
| 1 | 1-A | 119,000 | 5 | 7 |
| 1 | 1-B | 121,000 | 7 | 16 |
| 1 | 1-C | 121,000 | 5.5 | 12 |
| 1 | 1-D | 122,000 | 8 | 12 |
| 2 | 2-A | 56,500 | 3 | 3 |
| 2 | 2-B | 56,500 | 3 | 5 |
| 2 | 2-C | 58,000 | 3 | 4 |
| 2 | 2-D | 56,000 | 3 | 4 |

Table C shows the surprising result that reduction per pass schedule comprised of very light individual reductions provides a marked improvement in bend - strength combinations and in bend anisotropy for both alloys compared with the other reduction schedules employed. Thus, for example, the processing schedule identified by 1-A utilized a per pass reduction of between about 2 and 3% throughout the final cold reduction step. The processing schedule identified by 2-A utilized a per pass reduction of between about 2.6 and 3.6% throughout the final cold reduction step. It is also noted that process identification 1-A of the present invention obtains the greatest improvement; but also that pass identification 1-C of the present invention also obtains a marked improvement in good way bends. Whereas, process identifications 1-B and 1-D which do not satisfy the requirements of the present invention obtain relatively poorer properties. Similarly, process identification 2-A of the present invention obtains the greatest improvement; however, the process identifications 2-C and 2-D of the present invention also obtain improved bad way bends. On the other hand, process identification 2-B which does not satisfy the requirements of the present invention obtains a relatively poorer combination of properties.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A process for obtaining an improved combination of bend and strength properties in copper base alloys which comprises providing a copper base alloy strip having a thickness of less than 0.500 inch, subjecting said strip to a final cold reduction with a total reduction of at least 15% using several passes at least five of said passes having a per pass reduction varying from 0.5 to 4.0%.

2. A process according to claim 1 utilizing at least ten passes.

3. A process according to claim 2 wherein the total reduction is at least 30%.

4. A process according to claim 3 including at least one cold reduction of greater than 4% in the final cold reduction step.

5. A process according to claim 4 including at least one reduction of greater than 10% in the final cold reduction step.

6. A process according to claim 1 wherein the resultant product is characterized by high bend ductility with limited anisotropy combined with good strength properties.

7. A process according to claim 1 wherein said strip has a thickness of less than 0.200 inch.

8. A process according to claim 1 including a low temperature annealing step after the final cold reduction at a temperature of from 200° to 400°C for at least 15 minutes.

9. A process according to claim 1 wherein said copper base alloy is commercial purity copper.

10. A process according to claim 1 wherein said copper base alloy has a low stacking fault energy of less than 30 ergs per square centimeter and contains an element selected from the group consisting of about 2 to 12% aluminum, about 2 to 6% germanium, about 2 to 10% gallium, about 3 to 12% indium, about 1 to 5% silicon, about 4 to 12% tin, about 8 to 37% zinc and the balance essentially copper.

11. A process according to claim 10 wherein said alloy includes at least one second element different from the first element selected from the group consisting of about 0.001 to 10% aluminum, about 0.001 to 4% germanium, about 0.001 to 8% gallium, about 0.001 to 10% indium, about 0.001 to 4% silicon, about 0.001 to 10% tin, about 0.001 to 37% zinc, about 0.001 to 25% nickel, about 0.001 to 0.4% phosphorus, about 0.001 to 5% iron, about 0.001 to 5% cobalt, about 0.001 to 5% zirconium, about 0.001 to 10% manganese and mixtures thereof.

* * * * *